US011203110B2

(12) United States Patent
Lee et al.

(10) Patent No.: US 11,203,110 B2
(45) Date of Patent: Dec. 21, 2021

(54) CURVED GRIP

(71) Applicant: Cheng Uei Precision Industry Co., Ltd., New Taipei (TW)

(72) Inventors: Tsung Shih Lee, New Taipei (TW); Chi Ming Tseng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 109 days.

(21) Appl. No.: 16/881,295

(22) Filed: May 22, 2020

(65) Prior Publication Data

US 2021/0122026 A1 Apr. 29, 2021

(30) Foreign Application Priority Data

Oct. 29, 2019 (CN) ..... 201921837896.3

(51) Int. Cl.
*B25G 1/10* (2006.01)

(52) U.S. Cl.
CPC ..... *B25G 1/102* (2013.01)

(58) Field of Classification Search
CPC ..... B25G 1/102
See application file for complete search history.

(56) References Cited

U.S. PATENT DOCUMENTS 622,324 A * 4/1899 Brown ..... A45C 13/26 16/406
1,793,575 A * 2/1931 Williams ..... A45C 13/26 16/406
5,528,795 A * 6/1996 Gramegna ..... A45C 13/26 16/408
5,632,061 A * 5/1997 Smith ..... B60N 3/026 16/110.1
5,738,401 A * 4/1998 Fan ..... A45F 5/1046 294/137
2002/0116791 A1* 8/2002 Grady ..... B60N 3/02 16/444
2003/0159245 A1* 8/2003 Harman ..... G09F 23/06 16/110.1
2008/0313853 A1* 12/2008 Hale ..... A47B 95/02 16/111.1
2009/0207601 A1* 8/2009 Frick ..... F21V 23/0414 362/202

(Continued)

*Primary Examiner* — Jason W San
(74) *Attorney, Agent, or Firm* — Lin & Associates Intellectual Property, Inc.

(57) ABSTRACT

A curved grip includes an upper cover, a frame, a lower cover assembled with the upper cover and the frame, a first fastening component and a second fastening component which are mounted between the lower cover and the frame. The upper cover has a first accommodating space. The frame is mounted in the first accommodating space. A bottom of the frame is recessed inward to form a second accommodating space. Two ends of an inner surface of the second accommodating space slantwise protrude upward to form a first clamping block and a second clamping block. The first fastening component has a first base portion which protrudes outward and downward to form a first locking portion blocked by the first clamping block. The second fastening component has a second base portion which protrudes outward to form a second buckling portion blocked by the second clamping block.

18 Claims, 9 Drawing Sheets

(56) References Cited

U.S. PATENT DOCUMENTS

2010/0134973 A1* 6/2010 Lee ..... H04M 1/0216
361/679.56
2012/0106182 A1* 5/2012 Minter ..... E05B 41/00
362/501
2014/0250632 A1* 9/2014 Tebbe ..... A45F 3/02
16/411
2015/0202765 A1* 7/2015 Paternostro ..... A45F 5/10
294/141
2015/0233143 A1* 8/2015 Johnson ..... A47B 95/02
16/412
2015/0300047 A1* 10/2015 Leong ..... E05B 1/0092
16/111.1
2016/0059877 A1* 3/2016 Shah ..... B62B 9/20
16/421
2016/0060091 A1* 3/2016 Hecht ..... B67D 1/0086
362/109
2016/0096263 A1* 4/2016 Green ..... A61F 5/013
16/421

* cited by examiner

CURVED GRIP

CROSS REFERENCE TO RELATED APPLICATION

The present application is based on, and claims priority from, China Patent Application No. 201921837896.3, filed Oct. 29, 2019, the disclosure of which is hereby incorporated by reference herein in its entirety.

BACKGROUND OF THE INVENTION

1. Field of the Invention

The present invention generally relates to a curved grip, and more particularly to a curved grip which is tightly assembled.

2. The Related Art

With reference to FIG. 9, a conventional curved grip 100' includes an upper cover 1', a frame 2' and a lower cover 3'. The frame 2' is mounted in the upper cover 1'. The frame 2' opens a plurality of first fixing holes 221'. The lower cover 3' has a plurality of second fixing holes 35' recessed inward and corresponding to the plurality of the first fixing holes 221'. During an assembly of the conventional curved grip 100', the upper cover 1' and the lower cover 3' cover the frame 2' and are assembled with each other. Each second fixing hole 35' is communicated with one first fixing hole 221'. The conventional curved grip 100' further includes a plurality of fixing elements 6' pass through the plurality of the first fixing holes 221' and the plurality of the second fixing holes 35', so that the lower cover 3' and the frame 2' are fixed with each other.

However, because the upper cover 1' and the lower cover 3' are curved, multiple surfaces of the upper cover 1' and the lower cover 3' have multiple radians, and many parts and electronic components are assembled in the curved grip 100'. Therefore, designs of molds for molding the upper cover 1' and the lower cover 3' are limited by appearances of the upper cover 1' and the lower cover 3', and correspondingly, it is complex and limited for the molds to be opened. Moreover, in the design of the molds, two ends of the upper cover 1', two ends of the frame 2' and two ends of the lower cover 3' are hardly provided with the plurality of the first fixing holes 221' and the plurality of the second fixing holes 35'. So after the conventional curved grip 100' is assembled, two ends of the conventional curved grip 100' are without being combined tightly to generate a larger gap. The two ends of the curved grip 100' need be coated with glue to make the upper cover 1' and the lower cover 3' closely fit. Whereas, in a process of adhering the upper cover 1' with the lower cover 3', working hours of assembling the conventional curved grip 100' are increased, and when the conventional curved grip 100' needs to be reworked, the conventional curved grip 100' will be affected by a stronger adhesive force of the coated glue that will easily cause the parts or the electronic components to be damaged, and the conventional curved grip 100' is without being tightly assembled.

Therefore, it is necessary to provide an innovative curved grip, a lower cover, a frame and an upper cover of the innovative curved grip are tightly combined and are incapable of being loosened easily, so the innovative curved grip is tightly assembled.

SUMMARY OF THE INVENTION

An object of the present invention is to provide a curved grip. The curved grip includes an upper cover shown as an arc shape, a frame, a lower cover, a first fastening component and a second fastening component. The upper cover has a first accommodating space penetrating through a bottom surface of the upper cover. The first accommodating space has a first top wall, and two first lateral walls slantwise extended outward and downward from two opposite sides of the first top wall. The frame is shown as the arc shape. The frame is mounted in the first accommodating space. A bottom of the frame is recessed inward to form a second accommodating space. The second accommodating space has a second top wall, and two second lateral walls slantwise extended outward and downward from two opposite sides of the second top wall. Two ends of an inner surface of the second top wall of the second accommodating space slantwise protrude upward and towards each other to form a first clamping block and a second clamping block, respectively. A portion of one second lateral wall adjacent to the second clamping block extends inward to form an extending portion. One end of the extending portion protrudes towards the second clamping block to form a third clamping block. The frame further defines a buckling hole adjacent to the first clamping block. The lower cover is shown as the arc shape. The lower cover is matched with the upper cover and the frame. The lower cover is assembled with the upper cover and the frame, and the lower cover covers the bottom of the frame and the first accommodating space. The first fastening component is mounted between one end of the lower cover and the frame. The first fastening component has a first base portion. One end surface of the first base portion protrudes outward and downward to form a first locking portion. The first locking portion is disposed corresponding to and is blocked by the first clamping block. One side of the first base portion protrudes outward to form a first buckling portion. The first buckling portion is disposed corresponding to and is buckled in the buckling hole. The second fastening component is mounted between the other end of the lower cover and the frame. The second fastening component has a second base portion. One end of the second base portion protrudes outward to form a second buckling portion disposed corresponding to and blocked by the second clamping block. The other end of the second base portion protrudes outward and opposite to the second buckling portion to form a third buckling portion, and the third buckling portion is disposed corresponding to and blocked by the third clamping block.

Another object of the present invention is to provide a curved grip. The curved grip includes an upper cover shown as an arc shape, a frame, a lower cover, a first fastening component and a second fastening component. The upper cover is shown as an arc shape. The upper cover has a first accommodating space penetrating through a bottom surface of the upper cover. The frame is shown as the arc shape. The frame is mounted in the first accommodating space. A bottom of the frame is recessed inward to form a second accommodating space. Two ends of an inside of the second accommodating space slantwise protrude upward and towards each other to form a first clamping block and a second clamping block, respectively. One side of the inside of the second accommodating space adjacent to the second clamping block extends inward to form an extending portion. One end of the extending portion protrudes towards the second clamping block to form a third clamping block. The frame further defines a buckling hole adjacent to the first clamping block. The lower cover is shown as the arc shape. The lower cover is matched with the upper cover and the frame. The lower cover is assembled with the upper cover and the frame, and the lower cover covers the bottom of the frame and the first accommodating space. One end of a top surface of the lower cover protrudes outward to form at least one positioning column. The first fastening component is fastened between one end of the lower cover and the frame. The first fastening component has a first base portion. Two opposite ends of the first base portion protrude oppositely to form a positioning portion and a first locking portion. The first locking portion is blocked by the first clamping block. One side of the first base portion protrudes outward to form a first buckling portion buckled in the buckling hole. The positioning portion defines at least one positioning hole corresponding to the at least one positioning column. The at least one positioning column is positioned in the at least one positioning hole. The second fastening component is fastened between the other end of the lower cover and the frame. The second fastening component has a second base portion. One end of the second base portion protrudes outward to form a second buckling portion blocked by the second clamping block. The other end of the second base portion protrudes outward and opposite to the second buckling portion to form a third buckling portion blocked by the third clamping block.

Another object of the present invention is to provide a curved grip. The curved grip includes an upper cover shown as an arc shape, a frame, a bracket, a circuit board, a lower cover, a first fastening component and a second fastening component. The upper cover is shown as an arc shape. The upper cover has a first accommodating space penetrating through a bottom surface of the upper cover. The frame is shown as the arc shape. The frame is mounted in the first accommodating space. A bottom of the frame is recessed inward to form a second accommodating space. Two ends of an inside of the second accommodating space slantwise protrude upward and towards each other to form a first clamping block and a second clamping block, respectively. One side of the inside of the second accommodating space adjacent to the second clamping block extends inward to form an extending portion. One end of the extending portion protrudes towards the second clamping block to form a third clamping block. The frame further defines a buckling hole adjacent to the first clamping block. The bracket is mounted to the frame. The circuit board is mounted on the bracket. The lower cover is shown as the arc shape. The lower cover is matched with the upper cover and the frame. The lower cover is assembled with the upper cover and the frame, and the lower cover covers the bottom of the frame and the first accommodating space. The first fastening component is fastened between one end of the lower cover and the frame. The first fastening component has a first base portion. One end surface of the first base portion protrudes outward and downward to form a first locking portion blocked by the first clamping block. One side of the first base portion protrudes outward to form a first buckling portion buckled in the buckling hole. The second fastening component is fastened between the other end of the lower cover and the frame. The second fastening component has a second base portion. One end of the second base portion protrudes outward to form a second buckling portion blocked by the second clamping block. The other end of the second base portion protrudes outward and opposite to the second buckling portion to form a third buckling portion blocked by the third clamping block.

As described above, the first fastening component and the second fastening component are mounted to the lower cover, so the lower cover, the frame and the upper cover of the curved grip are tightly combined and are incapable of being loosened easily by virtue of the first fastening component, the second fastening component and the lower cover being combined with structures of the frame and the upper cover. As a result, the curved grip is tightly assembled.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
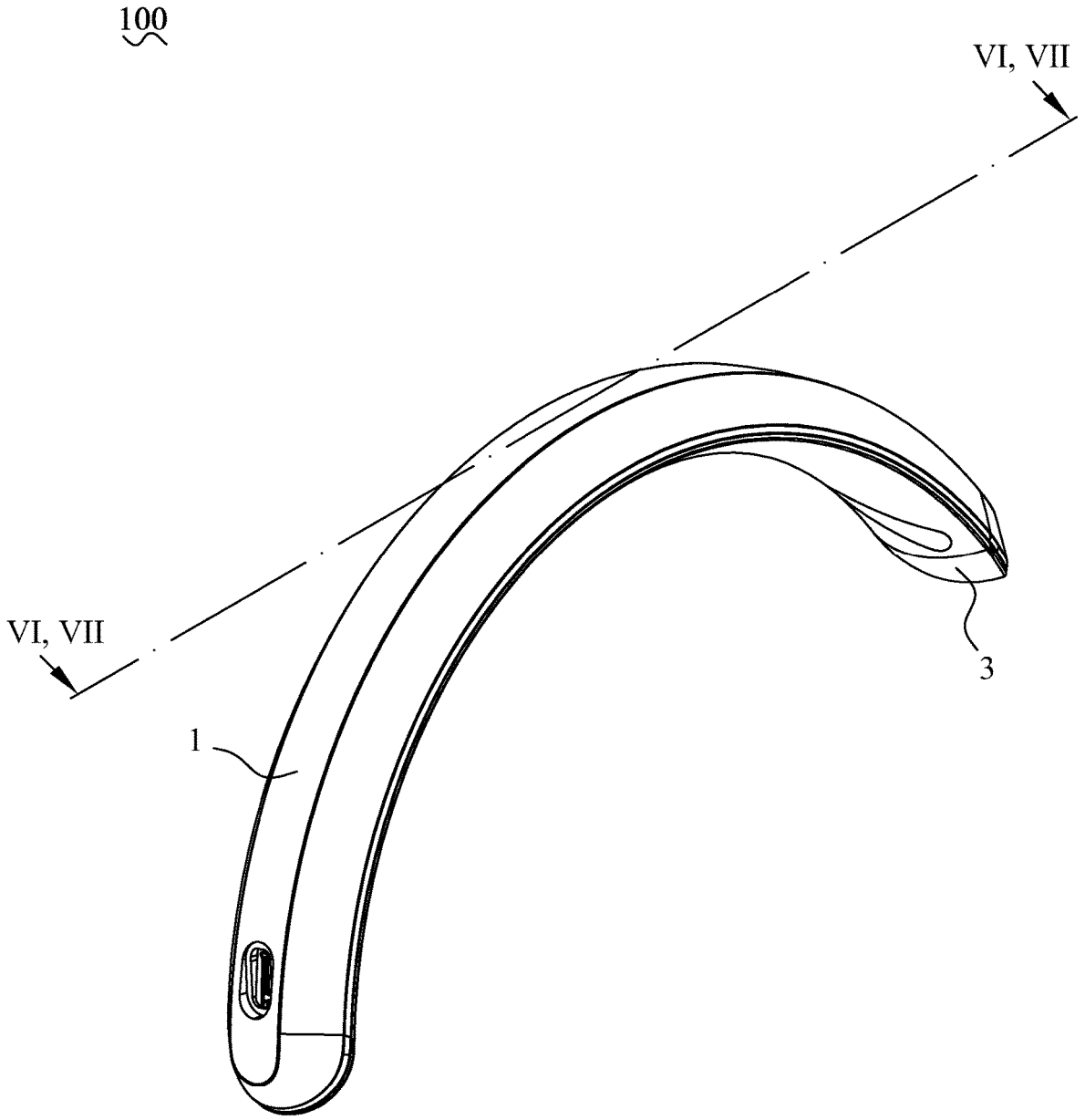
FIG. 1 is a perspective view of a curved grip in accordance with the present invention.
Figure 2:
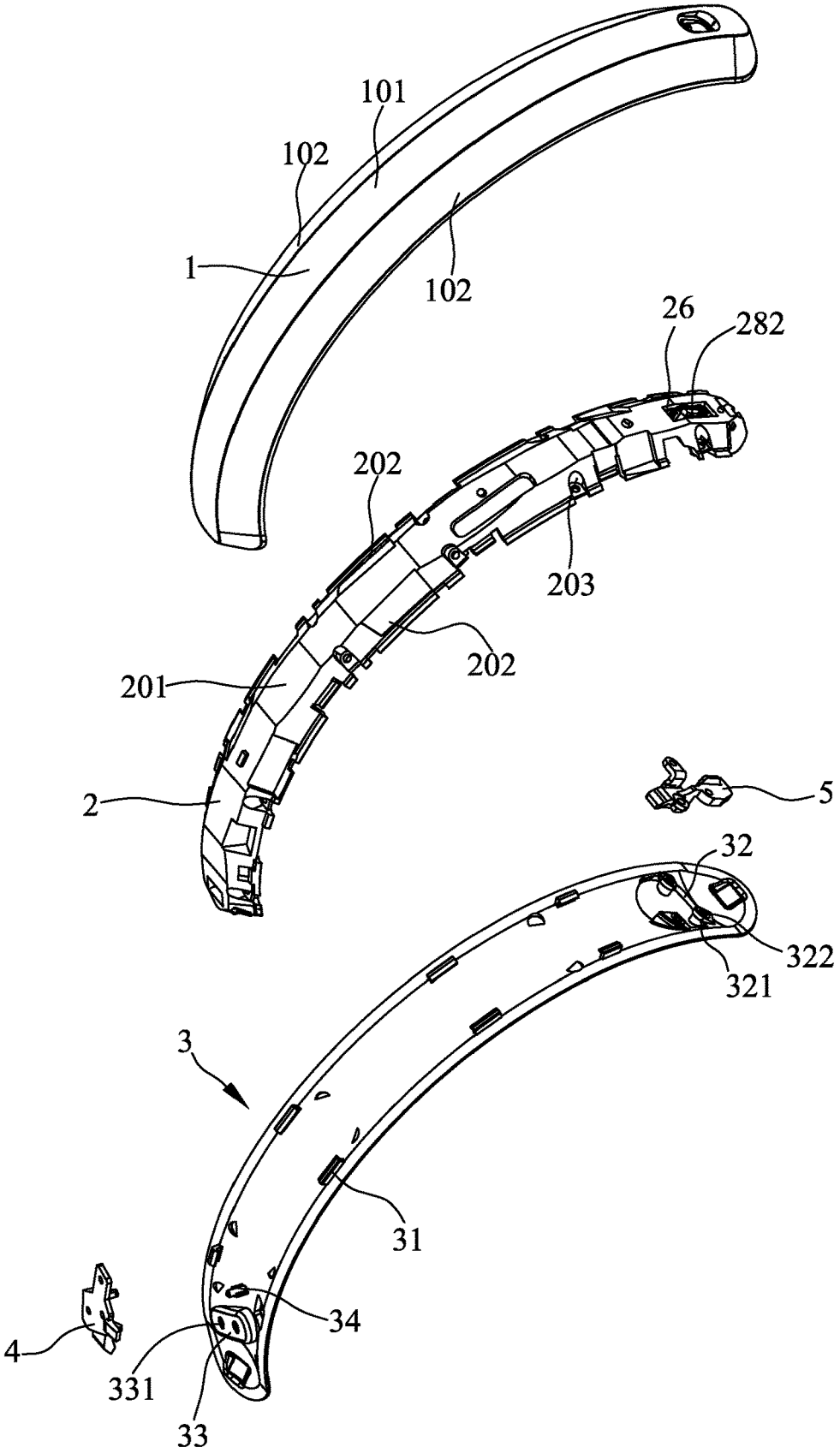
FIG. 2 is an exploded perspective view of the curved grip of FIG. 1.
Figure 3:
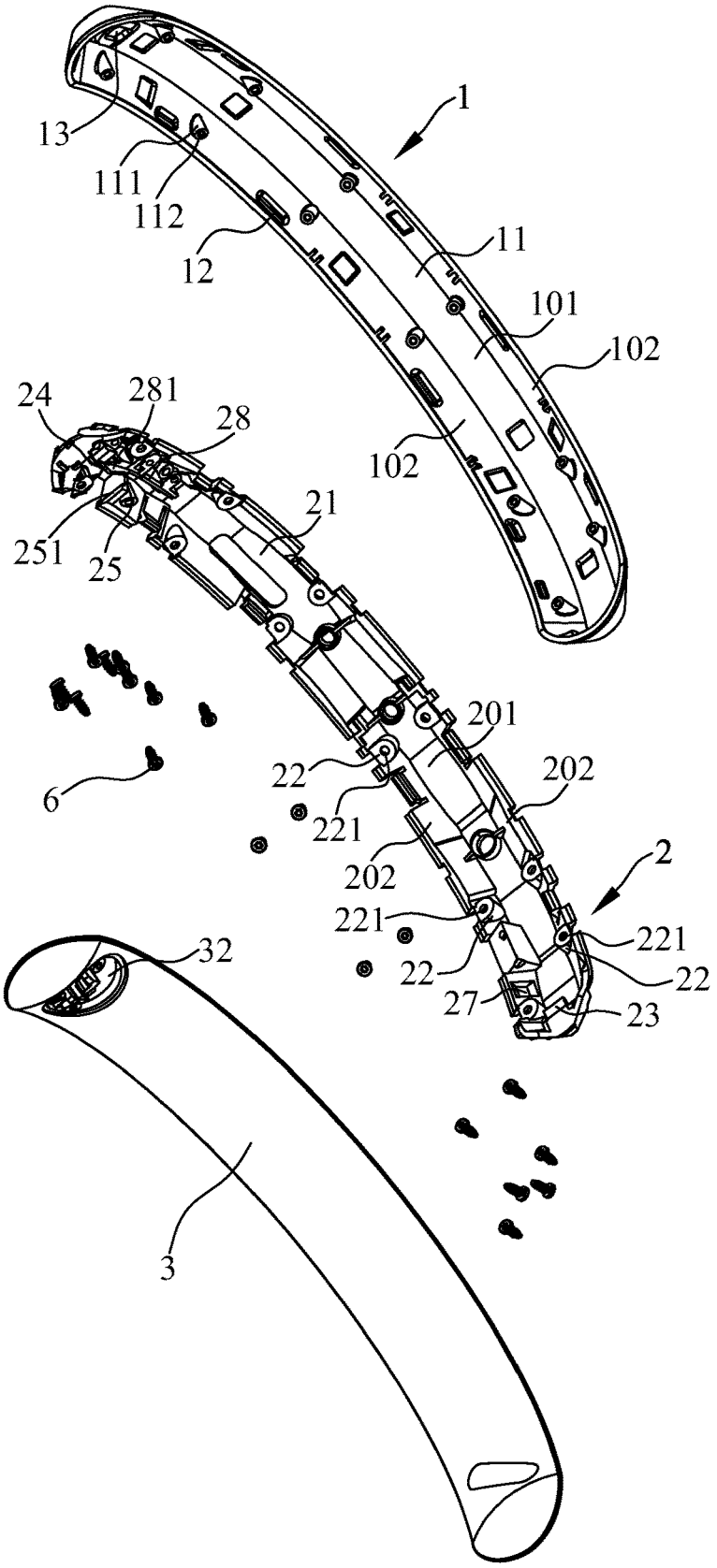
FIG. 3 is another exploded perspective view of the curved grip of FIG. 2.
Figure 4:
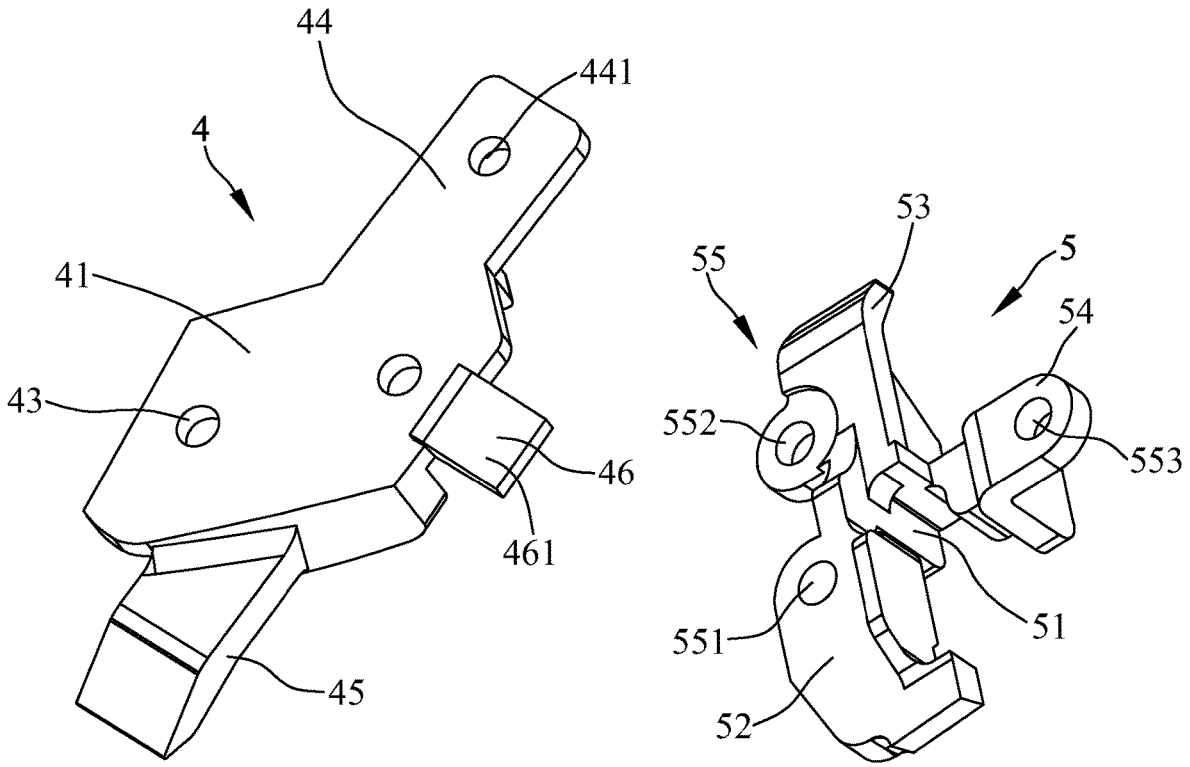
FIG. 4 is a perspective view showing a first fastening component and a second fastening component of the curved grip of FIG. 2.
Figure 5:
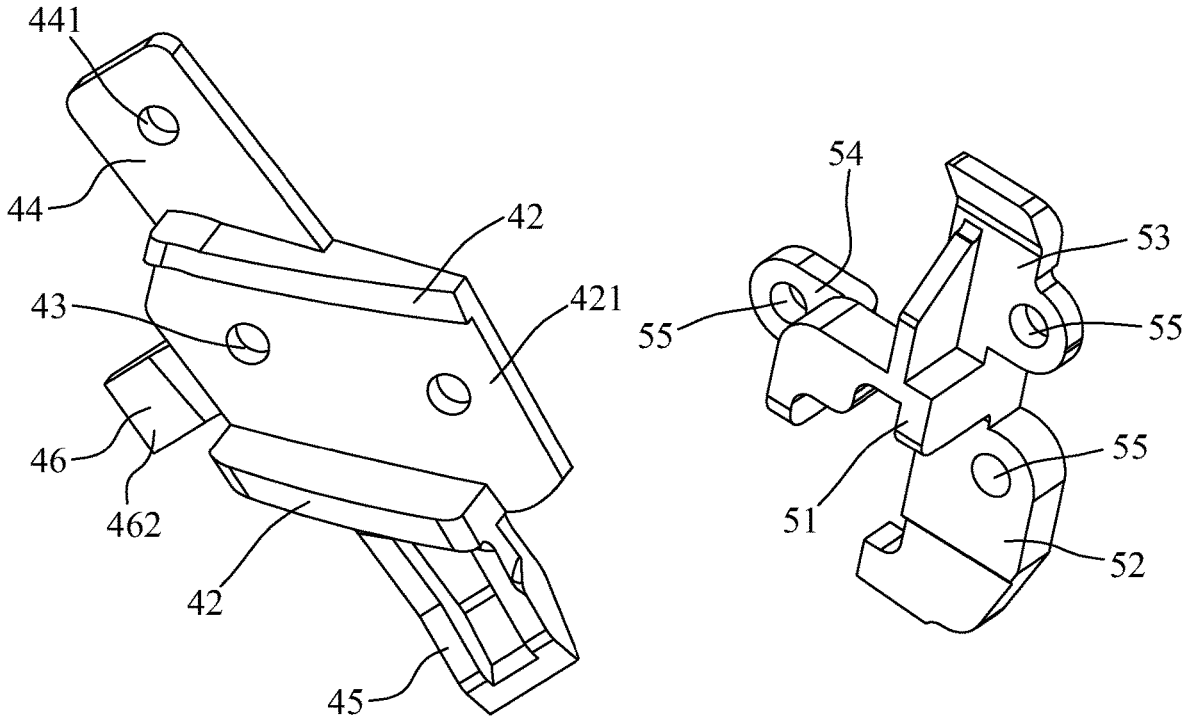
FIG. 5 is another perspective view showing the first fastening component and the second fastening component of the curved grip of FIG. 4.
Figure 6:
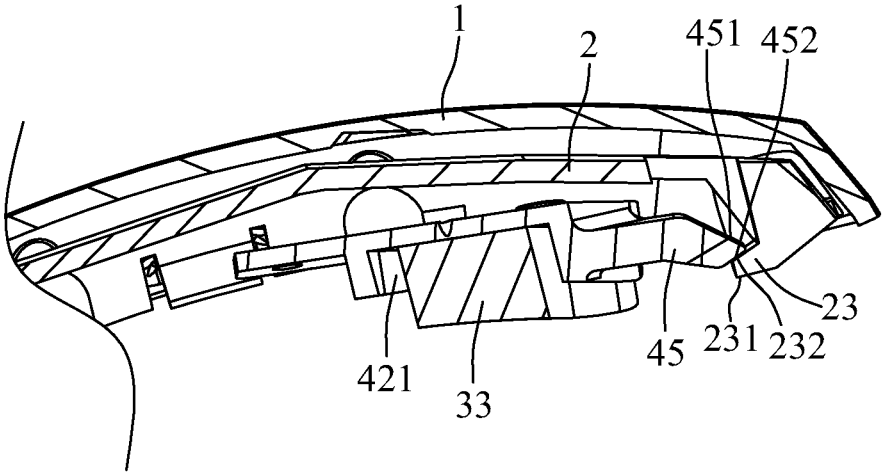
FIG. 6 is a sectional view of one end of the curved grip along a line VI-VI of FIG. 1.
Figure 7:
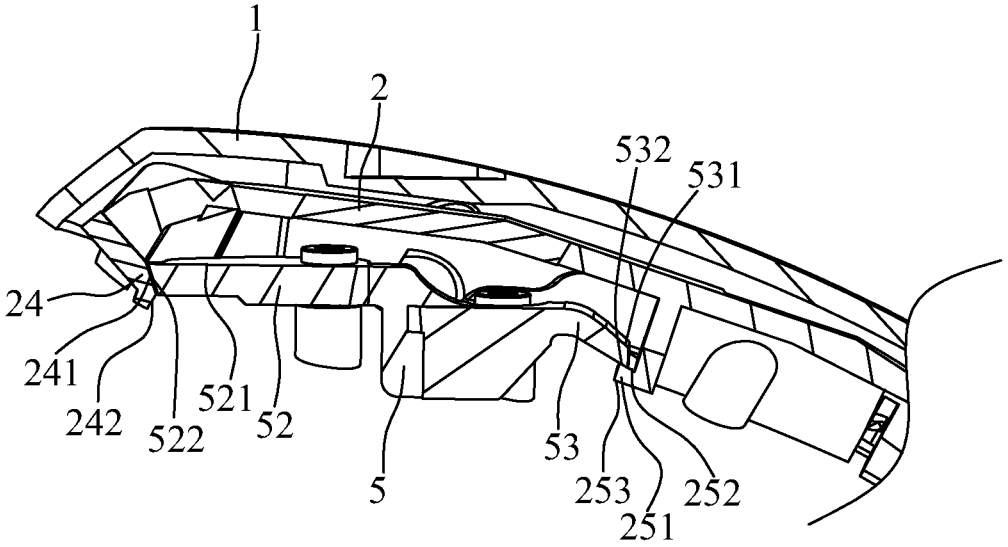
FIG. 7 is a sectional view of the other end of the curved grip along a line VII-VII of FIG. 1.
Figure 8:
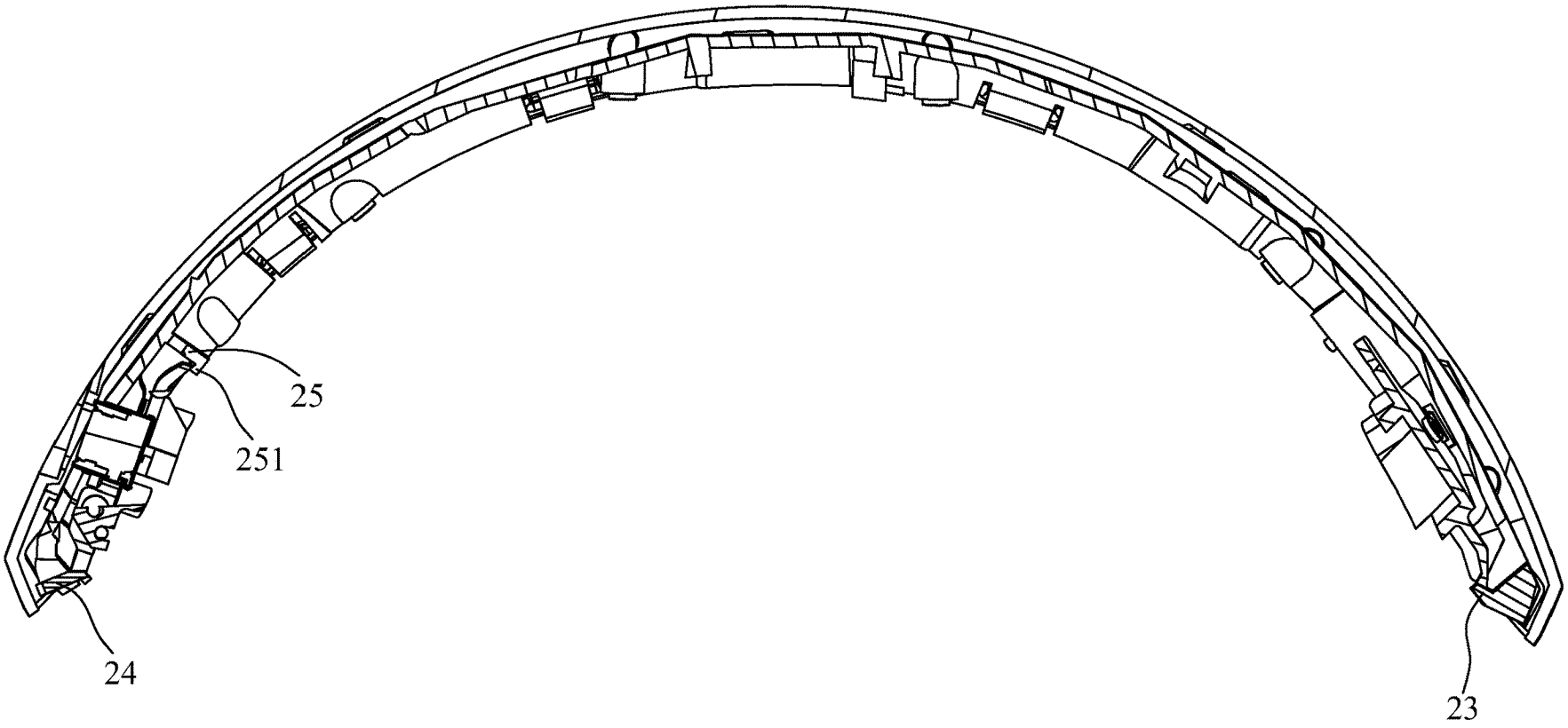
FIG. 8 is a sectional view of the curved grip along a line VIII-VIII of FIG. 1.
Figure 9:
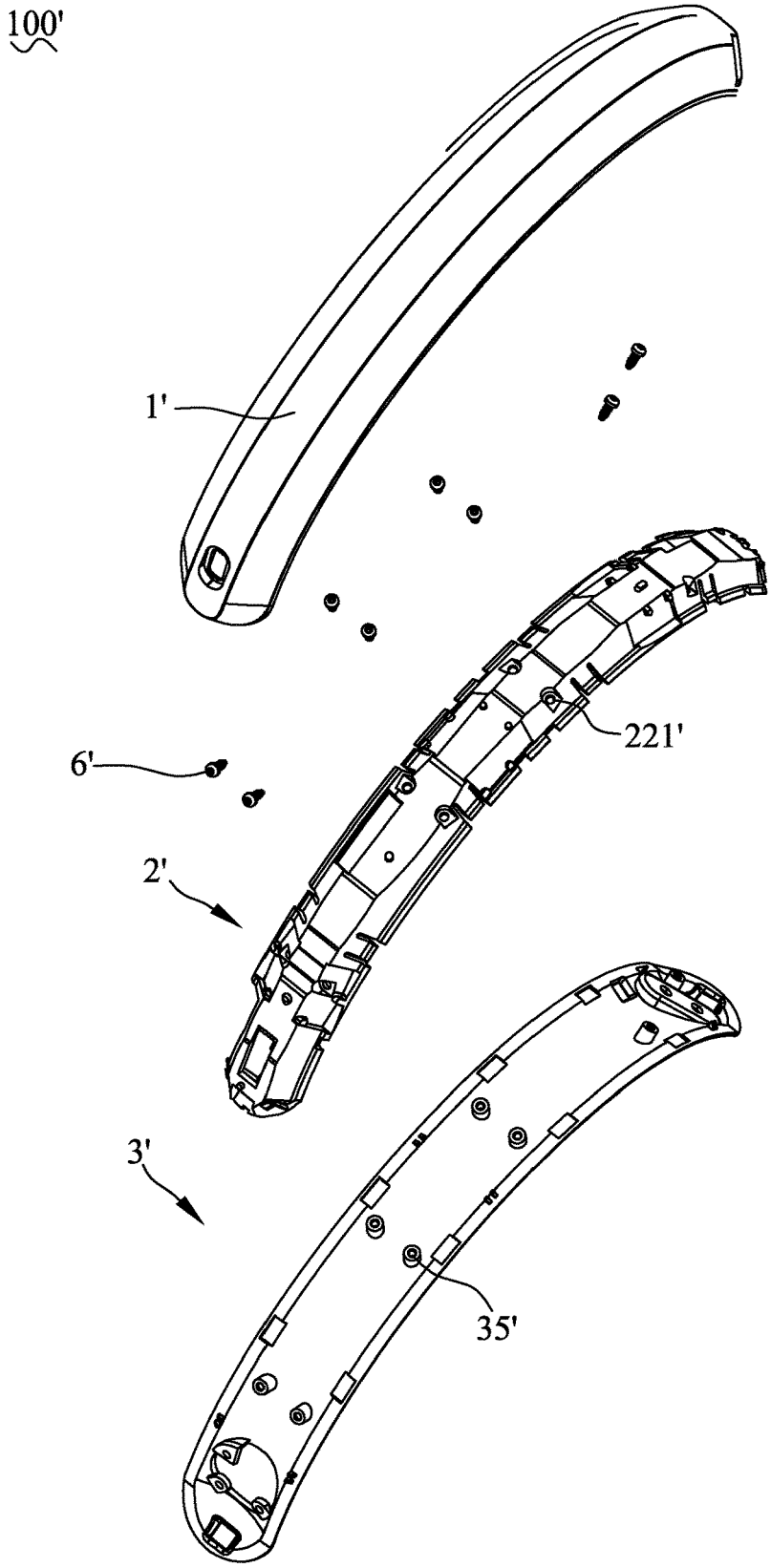
FIG. 9 (Prior Art)
FIG. 9 is an exploded perspective view of a conventional curved grip in prior art.

With reference to FIG. 1 to FIG. 3, a curved grip 100 in accordance with the present invention is shown. The curved grip 100 includes an upper cover 1, a frame 2, a lower cover 3, a first fastening component 4, a second fastening component 5 and at least one fixing element 6. The frame 2 is fastened between the upper cover 1 and the lower cover 3.

With reference to FIG. 1 to FIG. 3 again, the upper cover 1 is arched upward and shown as an arc shape. The upper cover 1 has a first accommodating space 11 penetrating through a bottom surface of the upper cover 1. The upper cover 1 has a plurality of first fixing pillars 111 protruded towards a top of the frame 2 from an inside of the first accommodating space 11. The first accommodating space 11 has a first top wall 101, and two first lateral walls 102 slantwise extended outward and downward from two opposite sides of the first top wall 101. Several portions of inner surfaces of the two first lateral walls 102 of the first accommodating space 11 protrude perpendicular to tangential directions of the two first lateral walls 102 to form the plurality of the first fixing pillars 111. The plurality of the first fixing pillars 111 project into the first accommodating space 11. A middle of each first fixing pillar 111 is recessed inward to form a first fixing hole 112 communicated with the first accommodating space 11. An inside of the upper cover 1 has a plurality of buckling grooves 12 sunken opposite to the first accommodating space 11. The plurality of the buckling grooves 12 are communicated with the first accommodating space 11. The upper cover 1 defines a first external interface 13 penetrating through the first top wall 101 of the first accommodating space 11, and communicated between an outside and the inside of the first accommodating space 11. The first external interface 13 is disposed near one end of the upper cover 1.

With reference to FIG. 2, FIG. 3, FIG. 6 and FIG. 8, the frame 2 is arched upward and is shown as the arc shape. The frame 2 is mounted in the first accommodating space 11. A bottom of the frame 2 is recessed inward to form a second accommodating space 21. The frame 2 has a plurality of second fixing pillars 22 protruded towards a top of the lower cover 3 from an inside of the second accommodating space 21. The second accommodating space 21 has a second top wall 201, and two second lateral walls 202 slantwise extended outward and downward from two opposite sides of the second top wall 201. Several portions of inner surfaces of the two second lateral walls 202 of the second accommodating space 21 protrude perpendicular to tangential directions of the two second lateral walls 202 to form the plurality of the second fixing pillars 22. A middle of each second fixing pillar 22 defines a second fixing hole 221 penetrating through the frame 2 along one tangential direction of the frame 2. Several portions of the top of the frame 2 are recessed inward to form a plurality of receiving grooves 203 corresponding to and communicated with the second fixing holes 221 of the plurality of the second fixing pillars 22.

The plurality of the second fixing pillars 22 are disposed corresponding to the plurality of the receiving grooves 203 and the plurality of the first fixing pillars 111. The plurality of the first fixing pillars 111 are received in the plurality of the receiving grooves 203. The second fixing holes 221 of the plurality of the second fixing pillars 22 are corresponding to the first fixing holes 112 of the plurality of the first fixing pillars 111, respectively. Two ends of the inside of the second accommodating space 21 slantwise protrude upward and towards each other to form a first clamping block 23 and a second clamping block 24, respectively. Two ends of an inner surface of the second top wall 201 of the second accommodating space 21 slantwise protrude upward and towards each other to form the first clamping block 23 and the second clamping block 24, respectively. A lower surface and an upper surface of the first clamping block 23 are defined as a first abutting surface 231 and a first contacting surface 232, respectively. The first abutting surface 231 and the first contacting surface 232 are both inclined surfaces. The first abutting surface 231 is slantwise extended upward and outward from a root end of the first abutting surface 231 to a free end of the first abutting surface 231. The first contacting surface 232 is slantwise extended upward and outward from a root end of the first contacting surface 232 to a free end of the first contacting surface 232.

Referring to FIG. 2, FIG. 3, FIG. 7 and FIG. 8, an upper surface and a lower surface of a free end of the second clamping block 24 are defined as a second abutting surface 241 and a second contacting surface 242, respectively. The second abutting surface 241 and the second contacting surface 242 are both inclined surfaces. The second abutting surface 241 is extended outward from top to bottom. The second contacting surface 242 is extended outward and frontward from a bottom end of the second abutting surface 241. One side of the inside of the second accommodating space 21 adjacent to the second clamping block 24 extends inward to form an extending portion 25. A portion of one second lateral wall 202 adjacent to the second clamping block 24 extends inward to form the extending portion 25. One end of the extending portion 25 protrudes towards the second clamping block 24 to form a third clamping block 251. An upper surface and a lower surface of the third clamping block 251 are defined as a third abutting surface 252 and a third contacting surface 253, respectively. A middle of one end of the frame 2 adjacent to the second clamping block 24 is hollowed out to form a second external interface 26 corresponding to the first external interface 13. The second external interface 26 is disposed between the second clamping block 24 and the extension portion 25. The other end of the frame 2 further defines a buckling hole 27 adjacent to the first clamping block 23. The curved grip 100 further includes a bracket 28 mounted to the frame 2, and a circuit board 281 mounted on the bracket 28, and a connector 282 mounted to the circuit board 281. The connector 282 is disposed corresponding to and is exposed to the second external interface 26.

With reference to FIG. 1 to FIG. 3, the lower cover 3 is arched upward and is shown as the arc shape. The lower cover 3 is matched with the upper cover 1 and the frame 2. The lower cover 3 is assembled with the upper cover 1 and the frame 2, and the lower cover 3 covers the bottom of the frame 2 and the first accommodating space 11. Several portions of two opposite sides of a top surface of the lower cover 3 protrude outward and opposite to a bottom surface of the lower cover 3 to form a plurality of buckling blocks 31. The plurality of the buckling blocks 31 are disposed corresponding to and buckled in the plurality of the buckling grooves 12. The lower cover 3 defines at least one third external interface 32 penetrating through the top surface and the bottom surface of the lower cover 3. The third external interface 32 is disposed corresponding to the first external interface 13.

Several portions of a peripheral wall of the third external interface 32 protrude inward to form a plurality of the third fixing pillars 321. Each third fixing pillar 321 has a perforation 322. In this preferred embodiment, the lower cover 3 includes three third fixing pillars 321. One end of a middle of the top surface of the lower cover 3 protrudes outward and opposite to the bottom surface of the lower cover 3 to form a protrusion 33 away from the third external interface 32. The protrusion 33 has at least one first fixing aperture 331 penetrating through the top surface and the bottom surface of the lower cover 3. In the preferred embodiment, the protrusion 33 has two first fixing apertures 331. The bottom surface of the lower cover 3 is recessed inward to form a locating groove 332 extending to a bottom of the protrusion 33. The one end of the top surface of the lower cover 3 protrudes outward to form at least one positioning column 34.

With reference to FIG. 2 to FIG. 8, the first fastening component 4 and the second fastening component 5 are mounted to the lower cover 3 and are respectively located at two free ends of the lower cover 3. The first fastening component 4 is mounted to and fastened to one end of the lower cover 3. The first fastening component 4 is mounted and fastened between the one end of the lower cover 3 and the frame 2. The first fastening component 4 has a first base portion 41. Two opposite ends of the first base portion 41 protrude perpendicular to the first base portion 41 and towards the other end of the lower cover 3 to form two limiting blocks 42 spaced from each other. The first fastening component 4 has an accommodating groove 421 formed among the two limiting blocks 42 and the first base portion 41, and the accommodating groove 421 is corresponding to the protrusion 33. The first fastening component 4 has at least one second fixing aperture 43 penetrating through the first base portion 41 along a direction perpendicular to the first base portion 41 and communicated with the accommodating groove 421. The at least one second fixing aperture 43 is corresponding to the at least one first fixing aperture 331. In the preferred embodiment, the first fastening component 4 has two second fixing apertures 43 communicated with the two first fixing apertures 331. The two opposite ends of the first base portion 41 protrude oppositely to form a positioning portion 44 and a first locking portion 45. One end surface of the first base portion 41 protrudes outward and downward to form the first locking portion 45. The other end surface of the first base portion 41 protrudes opposite to the first locking portion 45 to form the positioning portion 44. The two limiting blocks 42 are located between the positioning portion 44 and the first locking portion 45.

The positioning portion 44 defines at least one positioning hole 441 penetrating through the positioning portion 44 along a direction perpendicular to the positioning portion 44. The at least one positioning hole 441 is corresponding to the at least one positioning column 34. The first locking portion 45 is disposed corresponding to and is blocked by the first clamping block 23. An upper surface and a lower surface of a free end of the first locking portion 45 are defined as a first guiding surface 451, and a first buckling surface 452 matched with the first contacting surface 232, respectively. One side of the first base portion 41 protrudes outward to form a first buckling portion 46. The first buckling portion 46 is disposed corresponding to and is buckled in the buckling hole 27. An upper surface and a lower surface of a free end of the first buckling portion 46 are defined as a second guiding surface 461 and a second buckling surface 462, respectively. The second guiding surface 461 is inclined outward and towards the other end of the lower cover 3.

Referring to FIG. 2 to FIG. 8, the second fastening component 5 is mounted to and fastened to the other end of the lower cover 3. The second fastening component 5 is mounted and fastened between the other end of the lower cover 3 and the frame 2. The second fastening component 5 has a second base portion 51. One end of the second base portion 51 slantwise protrudes upward and towards the one end of the lower cover 3 to form a second buckling portion 52. The second buckling portion 52 is disposed corresponding to and blocked by the second clamping block 24. An upper surface and a lower surface of a free end of the second buckling portion 52 are defined as a third guiding surface 521, and a third buckling surface 522 matched with the second abutting surface 241, respectively. The third guiding surface 521 and the third buckling surface 522 are inclined surfaces. The second abutting surface 241 is disposed corresponding to the third buckling surface 522 of the second buckling portion 52.

One end of the third guiding surface 521 adjacent to the second clamping block 24 is slantwise extended outward and downward from top to bottom. One end of the third buckling surface 522 adjacent to the second clamping block 24 is slantwise extended outward and upward from bottom to top. The other end of the second base portion 51 protrudes opposite to the second buckling portion 52 to form a third buckling portion 53, and the third buckling portion 53 is disposed corresponding to the extension portion 25 and the third clamping block 251, and blocked by the third clamping block 251. An upper surface and a lower surface of a free end of the third buckling portion 53 have a fourth guiding surface 531 and a fourth buckling surface 532, respectively. The free end of the third buckling portion 53 is disposed to an outer side of the third clamping block 251. The fourth guiding surface 531 and the fourth buckling surface 532 are inclined surfaces. The fourth guiding surface 531 is inclined downward and outward from top to bottom. The fourth buckling surface 532 is inclined downward and outward from top to bottom.

One side of the second base portion 51 protrudes outward to form a fixing portion 54. The second buckling portion 52, the third buckling portion 53 and the fixing portion 54 define at least one through-hole 55 corresponding to the perforation 322 of the at least one third fixing pillar 321. Preferably, the second buckling portion 52, the third buckling portion 53 and the fixing portion 54 define a plurality of through-holes 55. The second buckling portion 52 has at least one first through-hole 551 penetrating through the second buckling portion 52 along a direction perpendicular to the second buckling portion 52. The third buckling portion 53 has at least one second through-hole 552 penetrating through the third buckling portion 53 along a direction perpendicular to the third buckling portion 53. The fixing portion 54 has at least one third through-hole 553 penetrating through the fixing portion 54 along a direction perpendicular to the fixing portion 54. The plurality of the through-holes 55 include the at least one first through-hole 551, the at least one second through-hole 552 and the third through-hole 553. The plurality of the through-holes 55 are corresponding to the perforations 322 of the plurality of the third fixing pillars 321 of the lower cover 3. In the preferred embodiment, the second buckling portion 52, the third buckling portion 53 and the fixing portion 54 define three through-holes 55 corresponding to the perforations 322 of the three third fixing pillars 321.

Referring to FIG. 2 to FIG. 8, the first base portion 41 of the first fastening component 4 is mounted on the protrusion 33, and two limiting blocks 42 are disposed to two opposite sides of the protrusion 33. The protrusion 33 is accommodated in the accommodating groove 421. The at least one positioning column 34 is positioned in the at least one positioning hole 441, and then the at least one second fixing aperture 43 is communicated with the at least one first fixing aperture 331, and the at least one fixing element 6 passes through the at least one second fixing aperture 43 and the at least one first fixing aperture 331 which are communicated with each other, so that the first fastening component 4 is fixed to the protrusion 33. Preferably, the curved grip 100 includes a plurality of fixing elements 6. The plurality of the through-holes 55 of the second fastening component 5 are communicated with the plurality of the perforations 322 of the plurality of the third fixing pillars 321 of the lower cover 3, and then the plurality of the fixing elements 6 pass through the plurality of the through-holes 55 and the perforations 322 of the plurality of the third fixing pillars 321 which are communicated with each other, so that the second fastening component 5 is fixed in the lower cover 3.

Referring to FIG. 1 to FIG. 8, when the curved grip 100 is assembled, at first, the frame 2 is placed in the first accommodating space 11 of the upper cover 1, so that the second fixing hole 221 of each second fixing pillar 22 and the fixing groove 112 of one first fixing pillar 111 are communicated with each other. The plurality of the fixing elements 6 pass through the second fixing holes 221 of the plurality of the second fixing pillars 22 and the fixing grooves 112 of the plurality of the first fixing pillars 111, respectively, so that the frame 2 is fixed in the first accommodating space 11 of the upper cover 1. Specifically, each fixing element 6 is a screw. The lower cover 3 is engaged with the upper cover 1 from bottom to top, so the frame 2 is fastened between the lower cover 3 and the upper cover 1. At this time, the plurality of the buckling blocks 31 are buckled in the plurality of the buckling grooves 12. The first locking portion 45 of the first fastening component 4 is hooked with the first clamping block 23. During the process of assembling of the curved grip 100, the first guiding surface 451 of the first locking portion 45 contacts the first abutting surface 231 of the first clamping block 23 in advance, and when the lower cover 3 is moved upward, the inclined first guiding surface 451 makes the free end of the first locking portion 45 arched outward. The first locking portion 45 passes beyond the first clamping block 23, and at the same time, the first locking portion 45 returns to an initial position, so that the first buckling surface 452 contacts with the first contacting surface 232 of the first clamping block 23.

Then, the second guiding surface 461 of the first buckling portion 46 contacts one side wall of the frame 2, and the side wall of the frame 2 is inclined outward and downward from top to bottom to be shown as an inclined wall. When the lower cover 3 is moved upward, the first buckling portion 46 is moved upward along the inclined second guiding surface 461, so that the free end of the first buckling portion 46 is bent downward and towards the other end of the lower cover 3. The first buckling portion 46 passes through and is buckled in the buckling hole 27, and at the same time, the first buckling portion 46 returns to an original position, so that the second buckling surface 462 is able to be contacted with a lower wall of the buckling hole 27. The third guiding surface 521 of the second buckling portion 52 contacts the second contacting surface 242 of the second clamping block 24 in advance. When the lower cover 3 is moved upward, the third guiding surface 521 makes the free end of the second buckling portion 52 arched outward and opposite to the one end of the lower cover 3. At last, the second buckling portion 52 passes beyond the second clamping block 24, and at the same time, the second buckling portion 52 returns to a start position, so that the third buckling surface 522 and the second abutting surface 241 of the second clamping block 24 are in contact.

The fourth guiding surface 531 of the third buckling portion 53 contacts the third contacting surface 253 of the third clamping block 251 in advance, and when the lower cover 3 is moved upward, the fourth guiding surface 531 makes the free end of the third buckling portion 53 bent downward and opposite to the one end of the lower cover 3. The third buckling portion 53 passes beyond the third clamping block 251, and at the same time, the third buckling portion 53 returns to a start location, so that the fourth buckling surface 532 and the third abutting surface 252 of the third clamping block 251 are in contact. In this way, the first fastening component 4 and the second fastening component 5 are combined with the frame 2, so that the lower cover 3, the frame 2 and the upper cover 1 may be tightly combined.

As described above, the first fastening component 4 and the second fastening component 5 are mounted to the lower cover 3, so the lower cover 3, the frame 2 and the upper cover 1 of the curved grip 100 are tightly combined and are incapable of being loosened easily by virtue of the first fastening component 4, the second fastening component 5 and the lower cover 3 being combined with structures of the frame 2 and the upper cover 1. As a result, the curved grip 100 is tightly assembled.

What is claimed is:

1. A curved grip, comprising:

an upper cover shown as an arc shape, the upper cover having a first accommodating space penetrating through a bottom surface of the upper cover, the first accommodating space having a first top wall, and two first lateral walls slantwise extended outward and downward from two opposite sides of the first top wall;

a frame shown as the arc shape, the frame being mounted in the first accommodating space, a bottom of the frame being recessed inward to form a second accommodating space, the second accommodating space having a second top wall, and two second lateral walls slantwise extended outward and downward from two opposite sides of the second top wall, two ends of an inner surface of the second top wall of the second accommodating space slantwise protruding upward and towards each other to form a first clamping block and a second clamping block, respectively, a portion of one second lateral wall adjacent to the second clamping block extending inward to form an extending portion, one end of the extending portion protruding towards the second clamping block to form a third clamping block, the frame further defining a buckling hole adjacent to the first clamping block;

a lower cover shown as the arc shape, the lower cover being matched with the upper cover and the frame, the lower cover being assembled with the upper cover and the frame, and the lower cover covering the bottom of the frame and the first accommodating space;

a first fastening component mounted between one end of the lower cover and the frame, the first fastening component having a first base portion, one end surface of the first base portion protruding outward and downward to form a first locking portion, the first locking portion being disposed corresponding to and being blocked by the first clamping block, one side of the first base portion protruding outward to form a first buckling portion, the first buckling portion being disposed corresponding to and being buckled in the buckling hole; and a second fastening component mounted between the other end of the lower cover and the frame, the second fastening component having a second base portion, one end of the second base portion protruding outward to form a second buckling portion disposed corresponding to and blocked by the second clamping block, the other end of the second base portion protruding outward and opposite to the second buckling portion to form a third buckling portion, and the third buckling portion being disposed corresponding to and blocked by the third clamping block.

2. The curved grip as claimed in claim 1, wherein the upper cover has a plurality of buckling grooves sunken opposite to the first accommodating space, several portions of two opposite sides of a top surface of the lower cover protrude outward and opposite to a bottom surface of the lower cover to form a plurality of buckling blocks, the plurality of the buckling blocks are disposed corresponding to and buckled in the plurality of the buckling grooves.

3. The curved grip as claimed in claim 1, wherein several portions of inner surfaces of the two first lateral walls of the first accommodating space protrude perpendicular to tangential directions of the two first lateral walls to form a plurality of first fixing pillars, the plurality of the first fixing pillars project into the first accommodating space, a middle of each first fixing pillar is recessed inward to form a first fixing hole communicated with the first accommodating space, several portions of inner surfaces of the two second lateral walls of the second accommodating space protrude perpendicular to tangential directions of the two second lateral walls to form a plurality of second fixing pillars, a middle of each second fixing pillar defines a second fixing hole penetrating through the frame along one tangential direction of the frame, the plurality of the second fixing pillars are disposed corresponding to the plurality of the first fixing pillars, the second fixing holes of the plurality of the second fixing pillars are corresponding to the first fixing holes of the plurality of the first fixing pillars.

4. The curved grip as claimed in claim 3, wherein several portions of a top of the frame are recessed inward to form a plurality of receiving grooves corresponding to and communicated with the second fixing holes of the plurality of the second fixing pillars, the plurality of the first fixing pillars are received in the plurality of the receiving grooves.

5. The curved grip as claimed in claim 1, further comprising a bracket mounted to the frame, a circuit board mounted on the bracket, and a connector mounted to the circuit board.

6. The curved grip as claimed in claim 5, wherein the upper cover defines a first external interface penetrating through the first top wall of the first accommodating space, and communicated between an outside and an inside of the first accommodating space, the first external interface is disposed near one end of the upper cover, a middle of one end of the frame adjacent to the second clamping block is hollowed out to form a second external interface corresponding to the first external interface, a portion of one second lateral wall adjacent to the second clamping block extends inward to form an extending portion, the second external interface is disposed between the second clamping block and the extension portion, the connector is disposed corresponding to and is exposed to the second external interface.

7. The curved grip as claimed in claim 6, wherein the lower cover defines at least one third external interface penetrating through a top surface and a bottom surface of the lower cover, the third external interface is disposed corresponding to the first external interface.

8. The curved grip as claimed in claim 7, wherein several portions of a peripheral wall of the third external interface protrude inward to form a plurality of third fixing pillars, each third fixing pillar has a perforation, one side of the second base portion protrudes outward to form a fixing portion, the second buckling portion, the third buckling portion and the fixing portion define a plurality of through-holes, the plurality of the through-holes are corresponding to the perforations of the plurality of the third fixing pillars of the lower cover.

9. The curved grip as claimed in claim 8, wherein the second buckling portion has at least one first through-hole penetrating through the second buckling portion along a direction perpendicular to the second buckling portion, the third buckling portion has at least one second through-hole penetrating through the third buckling portion along a direction perpendicular to the third buckling portion, the fixing portion has at least one third through-hole penetrating through the fixing portion along a direction perpendicular to the fixing portion, the plurality of the through-holes include the at least one first through-hole, the at least one second through-hole and the at least one third through-hole.

10. The curved grip as claimed in claim 7, wherein one end of a middle of a top surface of the lower cover protrudes outward and opposite to a bottom surface of the lower cover to form a protrusion away from the third external interface, the other end surface of the first base portion protrudes opposite to the first locking portion to form a positioning portion, two opposite ends of the first base portion protrude perpendicular to the first base portion and towards the other end of the lower cover to form two limiting blocks, the two limiting blocks are located between the positioning portion and the first locking portion, an accommodating groove is formed among the two limiting blocks and the first base portion, and the accommodating groove is corresponding to the protrusion, the protrusion is accommodated in the accommodating groove.

11. The curved grip as claimed in claim 10, wherein the protrusion has at least one first fixing aperture penetrating through the top surface and the bottom surface of the lower cover, the first fastening component has at least one second fixing aperture penetrating through the first base portion along a direction perpendicular to the first base portion and communicated with the accommodating groove, the at least one second fixing aperture is corresponding to the at least one first fixing aperture, the curved grip includes at least one fixing element, the at least one fixing element passes through the at least one second fixing aperture and the at least one first fixing aperture.

12. The curved grip as claimed in claim 10, wherein one end of the top surface of the lower cover protrudes outward to form at least one positioning column, the positioning portion defines at least one positioning hole penetrating through the positioning portion along a direction perpendicular to the positioning portion, the at least one positioning hole is corresponding to the at least one positioning column.

13. The curved grip as claimed in claim 1, wherein a lower surface and an upper surface of the first clamping block are defined as a first abutting surface and a first contacting surface, respectively, the first abutting surface and the first contacting surface are both inclined surfaces, an upper surface and a lower surface of a free end of the first locking portion are defined as a first guiding surface, and a first buckling surface matched with the first contacting surface, respectively, the first guiding surface of the first locking portion contacts the first abutting surface of the first clamping block in advance, and when the lower cover is moved upward, the first locking portion passes beyond the first clamping block, and the first buckling surface contacts with the first contacting surface of the first clamping block.

14. The curved grip as claimed in claim 13, wherein an upper surface and a lower surface of a free end of the first buckling portion are defined as a second guiding surface and a second buckling surface, respectively, the second guiding surface is inclined outward and towards the other end of the lower cover, the first buckling portion is moved upward along the inclined second guiding surface, the second buckling surface is able to be contacted with a lower wall of the buckling hole.

15. The curved grip as claimed in claim 14, wherein an upper surface and a lower surface of a free end of the second clamping block are defined as a second abutting surface and a second contacting surface, respectively, the second abutting surface and the second contacting surface are both inclined surfaces, an upper surface and a lower surface of a free end of the second buckling portion are defined as a third guiding surface, and a third buckling surface matched with the second abutting surface, the third guiding surface contacts the second contacting surface in advance, the second buckling portion passes beyond the second clamping block, and the third buckling surface and the second abutting surface are in contact.

16. The curved grip as claimed in claim 15, wherein an upper surface and a lower surface of the third clamping block are defined as a third abutting surface and a third contacting surface, respectively, an upper surface and a lower surface of a free end of the third buckling portion have a fourth guiding surface and a fourth buckling surface, respectively, the fourth guiding surface and the fourth buckling surface are inclined surfaces, the fourth guiding surface contacts the third contacting surface in advance, the third buckling portion passes beyond the third clamping block, and the fourth buckling surface and the third abutting surface are in contact.

17. A curved grip, comprising:

an upper cover shown as an arc shape, the upper cover having a first accommodating space penetrating through a bottom surface of the upper cover;

a frame shown as the arc shape, the frame being mounted in the first accommodating space, a bottom of the frame being recessed inward to form a second accommodating space, two ends of an inside of the second accommodating space slantwise protruding upward and towards each other to form a first clamping block and a second clamping block, respectively, one side of the inside of the second accommodating space adjacent to the second clamping block extending inward to form an extending portion, one end of the extending portion protruding towards the second clamping block to form a third clamping block, the frame further defining a buckling hole adjacent to the first clamping block;

a lower cover shown as the arc shape, the lower cover being matched with the upper cover and the frame, the lower cover being assembled with the upper cover and the frame, and the lower cover covering the bottom of the frame and the first accommodating space, one end of a top surface of the lower cover protruding outward to form at least one positioning column;

a first fastening component fastened between one end of the lower cover and the frame, the first fastening component having a first base portion, two opposite ends of the first base portion protruding oppositely to form a positioning portion and a first locking portion, the first locking portion being blocked by the first clamping block, one side of the first base portion protruding outward to form a first buckling portion buckled in the buckling hole, the positioning portion defining at least one positioning hole corresponding to the at least one positioning column, the at least one positioning column being positioned in the at least one positioning hole; and a second fastening component fastened between the other end of the lower cover and the frame, the second fastening component having a second base portion, one end of the second base portion protruding outward to form a second buckling portion blocked by the second clamping block, the other end of the second base portion protruding outward and opposite to the second buckling portion to form a third buckling portion blocked by the third clamping block.

18. A curved grip, comprising:

an upper cover shown as an arc shape, the upper cover having a first accommodating space penetrating through a bottom surface of the upper cover;

a frame shown as the arc shape, the frame being mounted in the first accommodating space, a bottom of the frame being recessed inward to form a second accommodating space, two ends of an inside of the second accommodating space slantwise protruding upward and towards each other to form a first clamping block and a second clamping block, respectively, one side of the inside of the second accommodating space adjacent to the second clamping block extending inward to form an extending portion, one end of the extending portion protruding towards the second clamping block to form a third clamping block, the frame further defining a buckling hole adjacent to the first clamping block;

a bracket mounted to the frame;

a circuit board mounted on the bracket;

a lower cover shown as the arc shape, the lower cover being matched with the upper cover and the frame, the lower cover being assembled with the upper cover and the frame, and the lower cover covering the bottom of the frame and the first accommodating space;

a first fastening component fastened between one end of the lower cover and the frame, the first fastening component having a first base portion, one end surface of the first base portion protruding outward and downward to form a first locking portion blocked by the first clamping block, one side of the first base portion protruding outward to form a first buckling portion buckled in the buckling hole; and a second fastening component fastened between the other end of the lower cover and the frame, the second fastening component having a second base portion, one end of the second base portion protruding outward to form a second buckling portion blocked by the second clamping block, the other end of the second base portion protruding outward and opposite to the second buckling portion to form a third buckling portion blocked by the third clamping block.

* * * * *